US007572163B2

(12) United States Patent
Sulcs et al.

(10) Patent No.: US 7,572,163 B2
(45) Date of Patent: Aug. 11, 2009

(54) HIGH INTENSITY DISCHARGE LAMPS, ARC TUBES, AND METHODS OF MANUFACTURE

(75) Inventors: Juris Sulcs, Chagrin Falls, OH (US); Abbas Lamouri, Aurora, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 558 days.

(21) Appl. No.: 11/179,653

(22) Filed: Jul. 13, 2005

(65) Prior Publication Data

US 2006/0014466 A1 Jan. 19, 2006

Related U.S. Application Data

(60) Provisional application No. 60/669,380, filed on Apr. 8, 2005, provisional application No. 60/587,048, filed on Jul. 13, 2004.

(51) Int. Cl.
*H01J 9/38* (2006.01)

(52) U.S. Cl. ..... 445/39; 445/23; 445/38; 445/42

(58) Field of Classification Search ..... 445/23, 445/38, 39, 42
See application file for complete search history.

(56) References Cited

U.S. PATENT DOCUMENTS

| | | | | |
|---|---|---|---|---|
| 5,101,134 | A * | 3/1992 | Rothwell et al. | 313/44 |
| 6,057,635 | A * | 5/2000 | Nishimura et al. | 313/25 |
| 6,612,892 | B1 * | 9/2003 | Lamouri et al. | 445/26 |
| 7,107,676 | B2 * | 9/2006 | Fridrich | 29/882 |

* cited by examiner

*Primary Examiner*—Nimeshkumar D. Patel
*Assistant Examiner*—Anne M Hines
(74) *Attorney, Agent, or Firm*—Duane Morris LLP

(57) ABSTRACT

The present application discloses high intensity discharge ("HID") lamps, arc tubes, and methods of manufacture. The application relates to HID lamps, arc tubes, and methods of manufacture wherein a precise amount of fill gas may be contained in the light-emitting chamber of the arc tube so that the pressure of the fill gas contained in the arc tube at substantially room temperature may be precisely controlled at pressures greater than about one-half atmosphere.

27 Claims, 4 Drawing Sheets

HIGH INTENSITY DISCHARGE LAMPS, ARC TUBES, AND METHODS OF MANUFACTURE

CLAIM OF PRIORITY

This application claims the benefit of U.S. Provisional Application Nos. 60/669,380 and 60/587,048, the disclosures of which are hereby incorporated by reference.

RELATED APPLICATIONS

The present application is related to commonly assigned U.S. Pat. No. 6,612,892 entitled "HIGH INTENSITY DISCHARGE LAMPS, ARC TUBES, AND METHODS OF MANUFACTURE," issued Sep. 2, 2003, commonly assigned U.S. Pat. No. 6,517,404 entitled "HIGH INTENSITY DISCHARGE LAMPS, ARC TUBES, AND METHODS OF MANUFACTURE," issued Feb. 11, 2003; and copending and commonly assigned U.S. patent application Ser. No. 10/457,442, entitled "HIGH INTENSITY DISCHARGE LAMPS, ARC TUBES, AND METHODS OF MANUFACTURE," filed Jun. 10, 2003, the disclosures of which are hereby incorporated by reference.

BACKGROUND OF THE INVENTION

The present invention generally relates to high intensity discharge ("HID") lamps, arc tubes, and methods of manufacture. More specifically, the present invention relates to HID lamps, arc tubes, and methods of manufacture wherein the pressure of the fill gas in the arc tube is greater than about one-half atmosphere at substantially room temperature.

Short arc gap metal halide lamps are particularly suited for fiber optic lighting systems, projection display, and automotive headlamps. Metal halide lamps with high pressure fill gas have been favored in many applications because of the fast warm-up, relatively long life, and relatively high efficiency in producing white light with good color rendition.

In the manufacture of such lamps, it is desirable to obtain a final fill gas pressure which is greater than one atmosphere at substantially room temperature. Final fill gas pressures greater than about five atmospheres are common and fill gas pressures may be as high as about two hundred atmospheres.

In the manufacture of metal halide lamps, it is known to obtain a superatmospheric fill gas pressure by freezing an amount of the fill gas (heretofore xenon) into the light emitting chamber of the lamp prior to sealing the chamber. The volume of gas frozen into the chamber (when at substantially one atmosphere and room temperature) is larger than the volume of the chamber so that the pressure of the gas sealed within the chamber is greater than one atmosphere when the temperature of the gas returns to substantially room temperature. The pressure of the fill gas sealed within the chamber at substantially room temperature equals the ratio of the volume of gas frozen into the chamber (at substantially one atmosphere and room temperature) relative to the volume of the chamber.

In the manufacture of superatmospheric arc tubes, it is difficult to control the amount of fill gas contained in the sealed arc tube due to the difficulty in preventing the escape of fill gas from the arc tube during the sealing process when the open tubular end portion of the arc tube is heated to about 2000° C. prior to pinch or shrink sealing the end portion.

Applicant has discovered a novel method for making superatmospheric arc tubes containing a fill gas such as xenon or krypton wherein the amount of the fill gas contained in the arc tube may be precisely controlled.

DETAILED DESCRIPTION

The present invention finds utility in arc tubes for all types and sizes of HID lamps and methods of manufacture of such lamps generally. By way of example only, certain aspects of the present invention will be described in connection with tipless quartz formed-body arc tubes.

Figure 1:
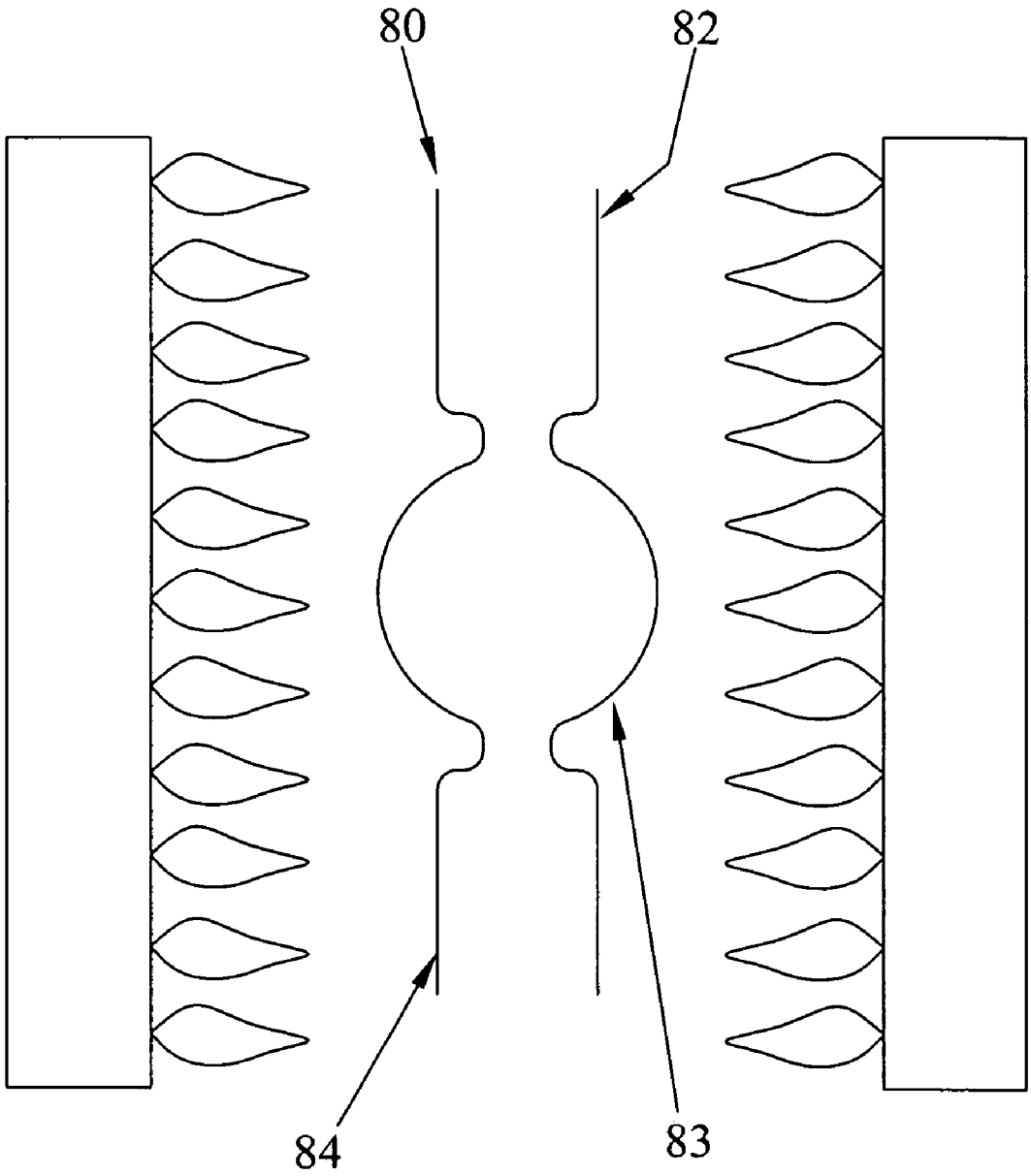
FIG. 1 illustrates the step of heating a pre-formed arc tube body.

FIG. 1 illustrates an arc tube body which has been formed from a quartz tube. The arc tube body 80 comprises a bulbous chamber 83 intermediate open tubular end portions 82,84. The arc tube body 80 may be formed using any suitable conventional method.

Figures 2A, 2B, 2C:
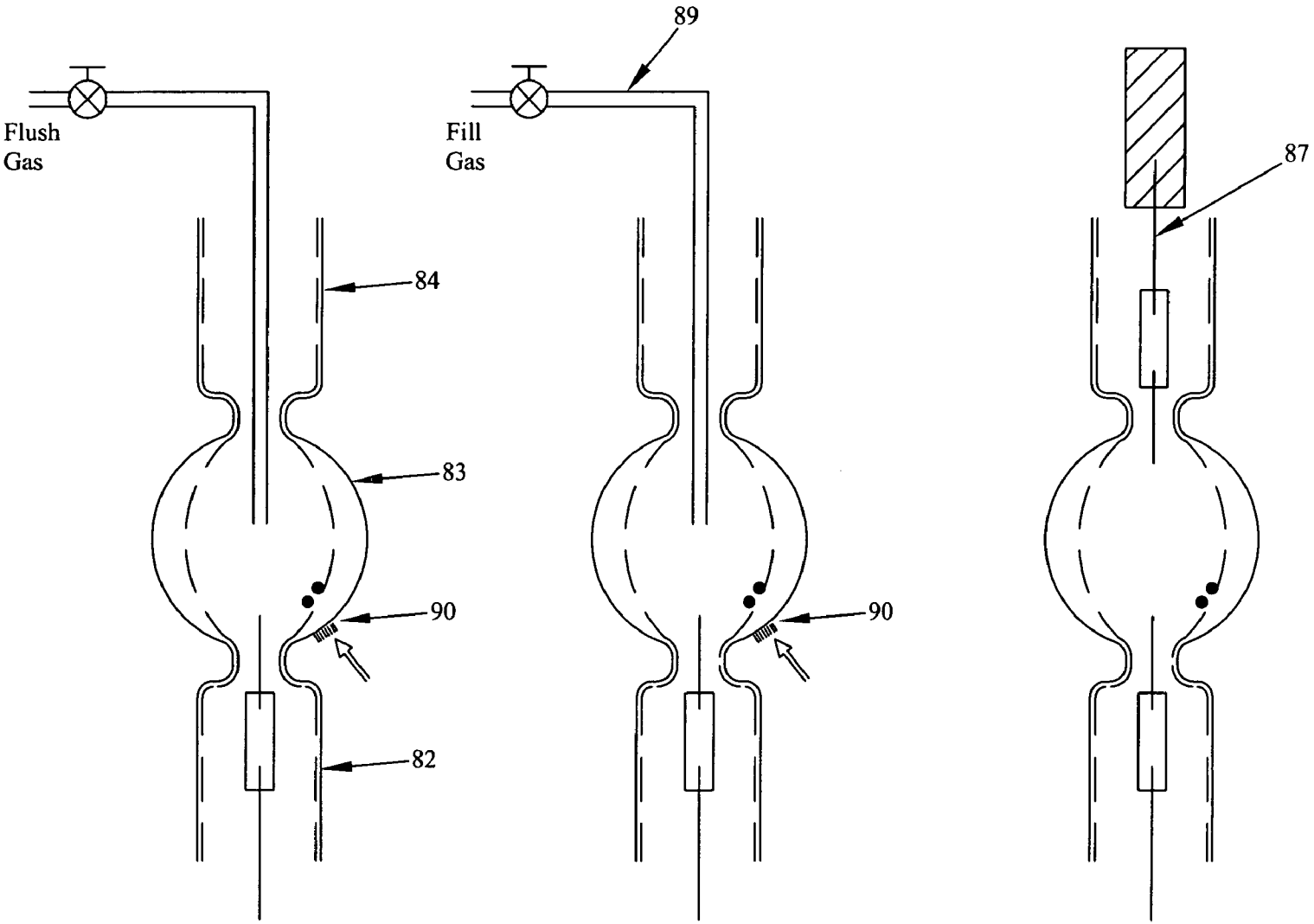
FIGS. 2*a*, 2*b*, and 2*c* illustrate the steps of flushing the arc tube body, injecting and freezing the fill gas, and pinch sealing the second end portion of the arc tube.

FIGS. 2*a*, 2*b*, and 2*c* illustrate several steps according to one embodiment of the present invention. With reference to FIGS. 2*a*, 2*b*, and 2*c*, the fill gas may be injected into the chamber 83 through a probe 89. While maintaining a blanket of inert gas over the electrode assembly 87, the temperature of the chamber 83 may be reduced to a temperature below the freezing point of the fill gas by any conventional means such as by the application of liquid nitrogen 90 (for example, by dip or spray). Once the desired temperature is reached, a volume of fill gas is injected and frozen into the chamber. The end portion 84 may then be hermetically sealed by any conventional sealing process such as pinch or shrink sealing. A cover gas may be applied to the open end during these process steps. The process according to this aspect of the invention results in acceptable levels of variability and a greatly reduced amount of time required to freeze the fill gas into the chamber, i.e., by several seconds or more.

It has been discovered that in the manufacture of superatmospheric arc tubes having a krypton fill, due to the lower freezing temperature of krypton with respect to xenon (i.e., −157° C. vs. −112° C.), it is difficult to precisely control the amount of krypton sealed within the arc tube due to evaporation losses during the sealing process. In the embodiment described above the open end of the arc tube may be heated to temperatures as high as 2000° C. in preparation for sealing while simultaneously reducing the temperature in the arc tube chamber to freeze the fill gas injected into the chamber. It is suspected that heat from the sealing process is transferred to the frozen fill gas via three primary means. First, radiative heat may be transferred from the arc tube heating apparatus, although this effect is understood to be minimal. Second, the quartz arc tube body may conduct heat into the arc tube chamber, although this effect is minimized due to the low thermal conductivity of quartz. Third, the gaseous fill in the chamber may conduct heat via convection from the heat source to the frozen fill gas.

It has been discovered that the amount of fill gas (for example, krypton) may be precisely controlled by evacuating the gaseous fill from the interior of the arc tube prior to heating the end portion for the sealing process. The evacuation of the gaseous fill eliminates the convective transfer of heat from the sealing process to the frozen fill gas, and thus significantly reduces the loss of fill gas by evaporation during the sealing process.

In an embodiment of the present invention, an arc tube having a superatmospheric pressure of fill gas (for example, argon, xenon, krypton, or mixtures thereof) may be obtained by using a vacuum pump flush process prior to freezing the fill gas into the arc tube chamber.

According to this embodiment, the pre-formed arc tube body 80 may be superheated using conventional techniques such as exposure to a flame as shown in FIG. 1. A flow of inert gas such as nitrogen (not shown) may be used to clean the surface of the arc tube after the temperature of the arc tube has been elevated.

Figure 3:
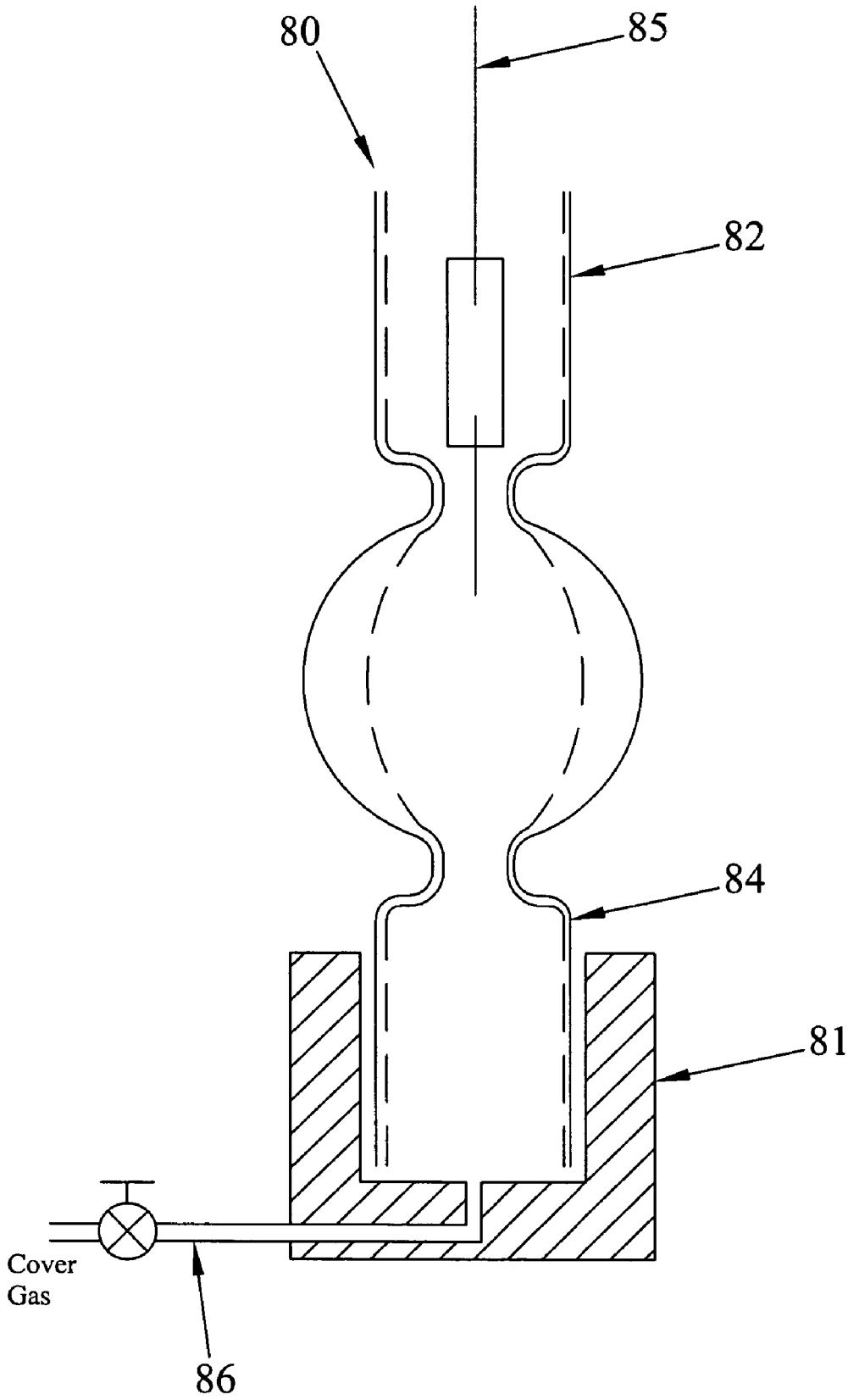
FIG. 3 illustrates the steps of positioning the first electrode lead assembly, flushing the arc tube, and pinch sealing the first end portion.

An electrode lead assembly 85 may then be positioned within the open tubular end portion 82 of the arc tube 80 by conventional means such as an insertion probe (not shown) as shown in FIG. 3. A flush gas assembly 86 connected to an arc tube holder 81 may be used to inject flush gas into the other open tubular end portion 84 of the arc tube 80 to provide an inert blanket around the electrode lead assembly 85 during the sealing process. The end portion 82 may be immediately sealed by any conventional sealing process such as pinch or shrink sealing once the electrode lead assembly 85 is fully inserted into the end portion 82 and blanketed by inert gas.

Figure 4:
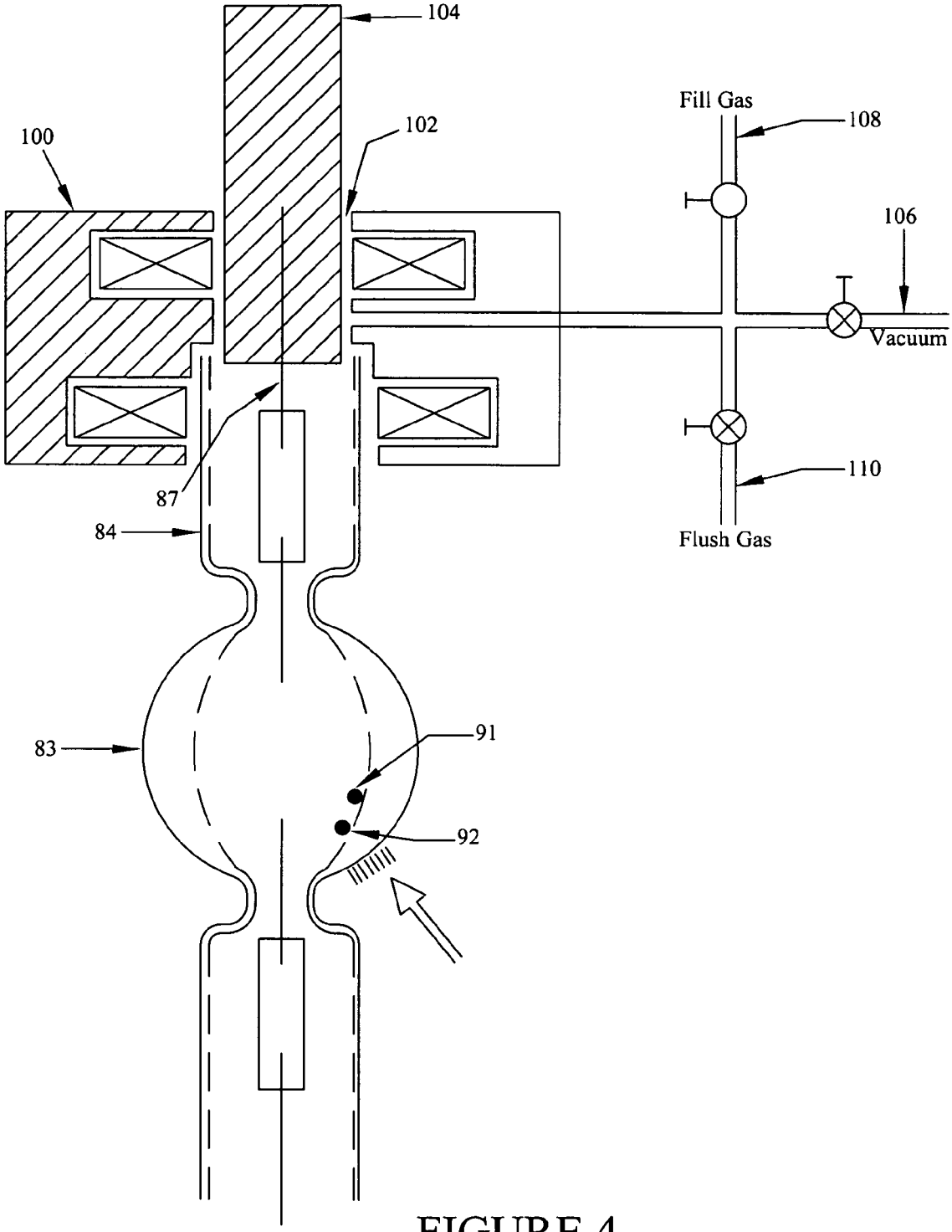
FIG. 4 illustrates the steps of evacuating the arc tube body, injecting the fill gas, evacuating excess fill gas, and pinch sealing the second end portion.

Next, the arc tube 80 having the electrode lead assembly 85 sealed in the end portion 82 may be dosed with the desired fill material by introducing the material into the arc tube chamber 83 through the open end portion 84. FIG. 4 illustrates an arc tube body 80 having lamp fill pellets 91 and mercury 92 within the arc tube chamber 83.

Once the arc tube 80 is dosed with the desired solid fill material, the open end portion 84 of the arc tube 80 may be mated with a pump flush block 100 as shown in FIG. 4. With reference to FIG. 4, the pump flush block 100 includes a central shaft 102 that communicates with the open end portion 84. The electrode lead assembly 87 may be inserted into the end portion 84 using the probe 104. The pump flush block 100 may include multiple ports 106, 108, and 110 for connection to a vacuum pump assembly (not shown), a source of inert gas (not shown), and a source of fill gas (not shown) at a pressure greater than greater than about one torr. The pressure of the fill gas is chosen to: optimize fill speed, provide a measurable pressure drop, and minimize the amount of fill gas for cost-effectiveness. For typical applications, pressures between 50 and 350 torr have been found suitable for a 5 cc source of fill gas.

Once the arc tube 80 is mated to the pump flush block 100, impurities in the arc tube may be removed by several methods. In one method, the arc tube may be thoroughly evacuated using a vacuum pump assembly through vacuum pump port 106. In another method, the impurities may be removed using a pump/flush process. In the pump/flush process, the arc tube is evacuated using the vacuum pump assembly, filled with an inert gas via fill port 108, and then evacuated again. The arc tube may be pump/flushed several times during which a preheat of the arc tube body and electrode assembly for a predetermined amount of time may be performed. When the impurities in the arc tube have been diluted to the desire level, the fill gas may be injected from the source of fill gas into the arc tube via the fill gas port 108 to fill the arc tube body and head volume of the pump flush block. The fill gas may then be frozen into arc tube chamber 83 by reducing the temperature below the freezing point of the fill gas by any conventional means such as by the application of liquid nitrogen 90 to the chamber 83. The amount of fill gas deposited in the arc tube may be precisely controlled by calculating the desired pressure drop in the system volume. For example, it may be determined that the amount of fill gas required to be frozen into the chamber is obtained by obtaining a pressure drop in the arc tube from 200 torr to 190 torr. In this example, the fill gas is introduced into the arc tube at 200 torr. The arc tube and head are isolated and the chamber is cooled by the application of liquid nitrogen until the pressure drops to 190 torr.

When the desired pressure differential is achieved, the arc tube may be evacuated again to remove the gaseous content of the chamber leaving only the frozen fill gas in the chamber. When a vacuum is drawn in the chamber, the end portion 84 may be hermetically sealed by any conventional sealing process such as pinch or shrink sealing.

The processes according to the present invention are also applicable to arc tubes where the electrodes are sealed in a single end of the arc tube. The arc tube may be flushed and dosed and then the two electrode lead assemblies may be inserted into the end portion of the arc tube. The evacuation, pump/flush, freezing of the fill gas, evacuation, and sealing steps may then be performed.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of making an arc tube for a high intensity discharge lamp wherein the arc tube includes a fill gas at superatmospheric pressure at substantially room temperature, said method comprising the steps of:

(a) providing an arc tube body having a light-emitting chamber;

(b) freezing a predetermined amount of fill gas in the chamber;

(c) evacuating gaseous fill from the chamber; and (d) hermetically sealing the chamber.

2. The method of claim 1 wherein the step of freezing fill gas into the chamber comprises introducing the fill gas through an open end portion of the arc tube body.

3. The method of claim 2 wherein the step of evacuating gaseous fill from the chamber comprises evacuating the gaseous fill through the open end portion.

4. The method of claim 3 wherein the step of hermetically sealing the chamber comprises pinch or shrink sealing the open end portion.

5. The method of claim 1 wherein the fill gas comprises krypton.

6. The method of claim 5 wherein the fill gas consists essentially of krypton.

7. The method of claim 1 wherein the pressure of the fill gas at substantially room temperature is between about 2 atmospheres and about 200 atmospheres.

8. The method of claim 7 wherein the pressure of the fill gas at substantially room temperature is between about 2 atmospheres and about 50 atmospheres.

9. The method of claim 8 wherein the pressure of the fill gas at substantially room temperature is between about 2 atmospheres and about 15 atmospheres.

10. The method of claim 1 wherein the step of freezing a predetermined amount of fill gas in the chamber comprises:

introducing the fill gas in the chamber from a fill gas source at a first pressure;

reducing the temperature of the chamber to a temperature below the freezing temperature of the fill gas so that an amount of fill gas in the chamber will freeze; and ceasing the introduction of fill gas into the chamber when the pressure of the fill gas is reduced to a second pressure.

11. A method of making an arc tube for a high intensity discharge lamp wherein the arc tube includes a fill gas at superatmospheric pressure at substantially room temperature, said method comprising the steps of:

(a) providing an arc tube body having a light-emitting chamber and an open end portion;

(b) introducing fill gas into the chamber through the open end portion;

(c) freezing a predetermined amount of fill gas in said chamber;

(d) evacuating gaseous fill from said chamber through said open end portion; and (e) hermetically sealing said chamber by sealing said open end portion.

12. The method of claim 11 wherein the step of introducing fill gas into the chamber and freezing a predetermined amount of fill gas in the chamber comprises:

providing a fill gas source at a first pressure;

reducing the temperature of the chamber to a temperature below the freezing temperature of the fill gas;

establishing fluid communication between the fill gas source and the chamber through the open end portion so that an amount of fill gas will freeze in the chamber; and isolating the fill gas source from the chamber when the pressure of the fill gas is reduced to a second pressure.

13. The method of claim 12 wherein the pressure difference between the first and second pressures is between about 5 torr and 50 torr.

14. The method of claim 13 wherein the pressure difference between the first and second pressures is about 10 torr.

15. The method of claim 11 wherein the fill gas comprises krypton.

16. The method of claim 15 wherein the fill gas consists essentially of krypton.

17. The method of claim 11 wherein the arc tube body comprises quartz.

18. The method of claim 11 wherein the arc tube body comprises the light-emitting chamber intermediate a pair of tubular end portions.

19. A method of making an arc tube comprising the steps of:

(a) providing an arc tube body comprising a light-emitting chamber intermediate a pair of open tubular end portions;

(b) positioning a first electrode lead assembly in one open tubular end portion while flushing the interior of the arc tube body with an inert gas introduced through the other open tubular end portion;

(c) hermetically sealing the one tubular end portion and fixing the position of the first electrode lead assembly relative to the arc tube body by pinch sealing the tubular end portion around the portion of the assembly positioned therein;

(d) introducing lamp fill material into the chamber through the open tubular end portion;

(e) positioning a second electrode lead assembly in the open tubular end portion;

(f) sealing and evacuating the gaseous content of the chamber through the open tubular end portion;

(g) providing a fill gas source at a first predetermined pressure;

(h) reducing the temperature of the chamber below the freezing temperature of the fill gas;

(i) establishing fluid communication between the fill gas source and the chamber through the open tubular end portion to thereby introduce fill gas into the chamber and freeze an amount of the fill gas in the chamber;

(j) isolating the fill gas source from the chamber when the pressure of the fill gas is reduced to a second predetermined pressure;

(k) evacuating gaseous fill from the chamber through the open tubular end portion;

(l) hermetically sealing the chamber by and fixing the position of the second electrode lead assembly relative to the arc tube body by pinch sealing the tubular end portion around the portion of the assembly positioned therein.

20. The method of claim 19 further comprising the step of performing one or more pump and flush cycles after the step of sealing and evacuating the gaseous content from the chamber and prior to the step of providing a fill gas source at a first predetermined pressure.

21. The method of claim 20 further comprising the step of elevating the temperature of the arc tube body during the pump and flush cycles.

22. The method of claim 19 wherein the step of reducing the temperature of the chamber comprises exposing the chamber to liquid nitrogen.

23. The method of claim 19 wherein the fill gas comprises krypton.

24. The method of claim 23 wherein the fill gas consists essentially of krypton.

25. The method of claim 23 wherein the fill gas consists essentially of xenon and krypton.

26. A method of controlling the amount of gas frozen into the light-emitting chamber of an arc tube body comprising the steps of:

reducing the temperature of the chamber to a temperature below the freezing temperature of the fill gas;

establishing fluid communication between the chamber and a source of fill gas at a first predetermined pressure to thereby introduce and freeze an amount of fill gas into the chamber; and isolating the chamber from the fill gas source when the pressure of the fill gas is reduced to a second predetermined pressure.

27. The method of claim 26 further comprising the step of evacuating gaseous fill after the chamber is isolated from the fill gas source.

* * * * *